US007628646B1

(12) United States Patent
Lee

(10) Patent No.: US 7,628,646 B1
(45) Date of Patent: Dec. 8, 2009

(54) CABLE CONNECTOR AND METHOD OF ASSEMBLING CABLE CONNECTOR AND CABLE

(75) Inventor: Ching-Hsi Lee, Taichung (TW)

(73) Assignee: Cablesat International Co., Ltd., Taichung City (TW)

( * ) Notice: Subject to any disclaimer, the term of this patent is extended or adjusted under 35 U.S.C. 154(b) by 1 day.

(21) Appl. No.: 12/166,041

(22) Filed: Jul. 1, 2008

(51) Int. Cl.
*H01R 9/05* (2006.01)

(52) U.S. Cl. ..... 439/578

(58) Field of Classification Search ..... 439/578, 439/584, 585, 583
See application file for complete search history.

(56) References Cited

U.S. PATENT DOCUMENTS 3,321,732 A * 5/1967 Forney, Jr. ..... 439/322
4,545,637 A * 10/1985 Bosshard et al. ..... 439/578
7,303,435 B2 * 12/2007 Burris et al. ..... 439/578
7,384,308 B2 * 6/2008 Boehnlein et al. ..... 439/585
7,410,389 B2 * 8/2008 Holliday ..... 439/578
2008/0064259 A1 * 3/2008 Amidon ..... 439/578

* cited by examiner

*Primary Examiner*—Michael C Zarroli
(74) *Attorney, Agent, or Firm*—Browdy and Neimark, PLLC

(57) ABSTRACT

A cable connector of the present invention includes a main member and a needle. For an initial condition, the needle is received in the main member that a cable may be coupled to the needle from a connection end of the main member to have a center conductor thereof electrically connected to the needle. Next, the cable may be pulled to draw the needle out of the main member. Next, the main member is reversed to have an outlet end facing the needle, and the needle may be inserted into the main member to complete the connection of the cable and the cable connector.

7 Claims, 3 Drawing Sheets

CABLE CONNECTOR AND METHOD OF ASSEMBLING CABLE CONNECTOR AND CABLE

BACKGROUND OF THE INVENTION

1. Field of the Invention

The present invention relates to connection of a cable and a cable connector and more particularly, to a method of assembling a cable connector and a cable and the structure of the cable connector.

2. Description of the Related Art

Typically, conventional cable connectors are classified into two types. The first type is that the connector and the needle are two independent elements, and the needle is attached on an outer side of the connector by tape or wire. The second type is that the needle is a part of the connector, and the needle is fixed inside the connector.

Therefore, there are two methods of assembling the cable connectors. A method of assembling the first type cable connector, which the connector and the needle are two independent elements, is that the operator has to grip the tinny needle and insert it into a cooper center conductor of a cable, and then insert the cable together with the needle into the connector. A drawback of above assembling method is that it is a hard job for an operator to grip the tinny needle and insert it into the cable. It is just like threading the needle. To help this job, the operators used to operate a pliers or a clamp to hold the needle.

The method of assembling the second type cable connector, which the needle is a part of the connector therein, is that the operator holds the connector directly and inserts a cable into the connector that the center conductor of the cable will be connected to the needle in the connector. There is no problem to hold the connector in this method, but the operator can't identify that whether the center conductor is connected to the needle because the needle is hidden in the connector and there is no visual contact in the assembling task. It has to process a test to identify the conduction of the center conductor and the needle. If not, the operator has to pull the connector out and reassemble them again. When the needle only touches an outer end of the center conductor, it will pass the test. But it is a defective product and can't be found.

SUMMARY OF THE INVENTION

The primary objective of the present invention is to provide a method of assembling a cable connector and a cable and the structure of the cable connector, which the method is simple and reliable, and it will not lose the needle.

To achieve the objective of the present invention, a cable connector of the present invention includes a main member and a needle. For an initial condition, the needle is received in the main member that a cable may be coupled to the needle from a connection end of the main member to have a center conductor thereof electrically connected to the needle. Next, the cable may be pulled to draw the needle out of the main member. Next, the main member is reversed to have an outlet end facing the needle, and the needle may be inserted into the main member to complete the connection of the cable and the cable connector.

DETAILED DESCRIPTION OF THE INVENTION

Figure 1:
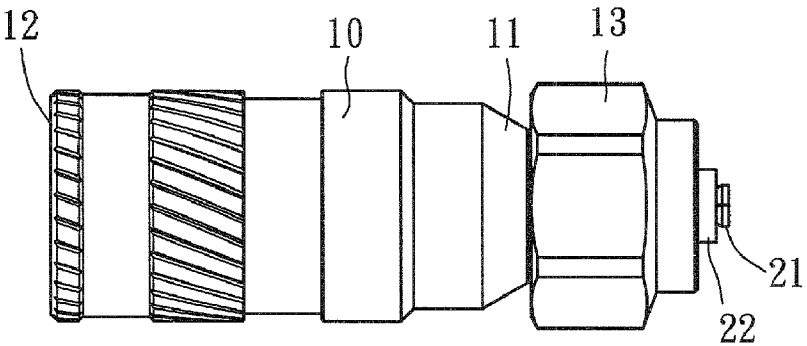
FIG. 1 is a lateral view of the cable connector before assembly of a preferred embodiment of the present invention.

Referring to FIGS. 1~6, the present invention provides a cable 2 having a cooper center conductor 1 and a cable connector. The cable connector includes:

A tubular main member 10 has an outlet end 11 and a connection end 12. A nut 13 is provided onto the outlet end 11 of the main member 10 for rotation. The main member 10 has a through hole 14, which has a diameter greater at an end on the connection end 12 and gradually narrowed to an end on the outlet end 11. In other words, the through hole 14 is greater at the end on the connection end 12 and is smaller at the end on the outlet end 11.

A needle 20 is provided on the outlet end 11 of the maim member 10 in a reverse direction and it is detachable. The needle 20 includes a connection end 21 on an end thereof and a tip on the other end. The tip of the needle 20 is pointed toward the connection end 12 of the main member 10 and the connection end 21 of the needle 20 is pointed toward the outlet end 11. The connection end 21 of the needle 20 extends out of the main member 10. The needle 20 includes a barrel 22, which has a front section 23 with a smaller diameter and a rear section 24 with a greater diameter. The front section 23 is smaller than the through hole 14 on outlet end 11, and the rear section 24 is greater than the through hole 14 on outlet end 11. Before assembling, the front section 23 of the barrel 22 is inserted into through hole 14 on the outlet end 14, and the needle 20 is received in through hole 14 with the tip thereof pointed toward the connection end 12.

A method of assembling the cable 2 and the cable connector of the present invention includes the following steps:

First, inserting the cooper center conductor 1 of the cable 2 into the barrel 22 to connect the cooper center conductor 1 to the connection end 21 of the needle 20. This is a reverse connectional action. And then, pulling the cable 2 that the needle 20 and the barrel 22 will be drawn out of the through hole 14 of the main member 10 because the needle 20 is connected to the cooper center conductor 1 tightly. Now, turning reversing the main member 10 to have the connection end 12 facing the tip of needle 20, and then inserting the needle 20 and the front section 23 of the barrel 22 into the through hole 14 on the connection end 12.

Figure 2:
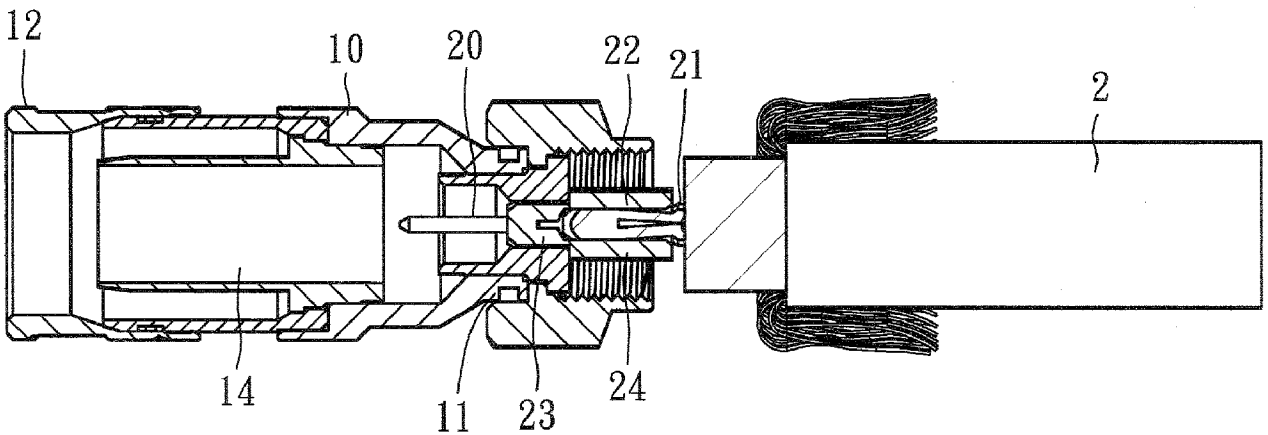
FIG. 2 is a sectional view of the preferred embodiment of the present invention, showing the cable and the needle for reverse connection.
Figure 3:
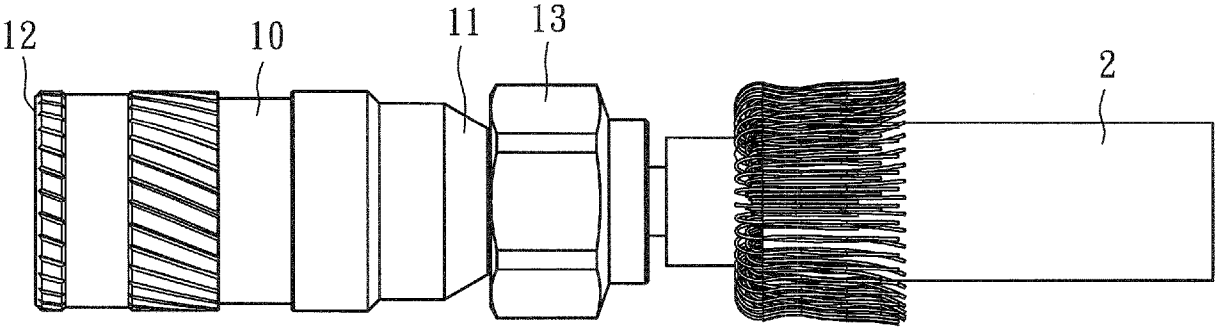
FIG. 3 is a lateral view of the preferred embodiment of the present invention, showing the cable and the needle for reverse connection.

As shown in FIG. 2, before assembling, the needle 20 is connected to the outlet end 11 of the main member 10 in the reverse direction, and the connection end 21 of the barrel 22 is left out of the main member 10. An operator may hold the cable 2 and insert it into the barrel 22 directly. It would be easier than holding the needle in the conventional assembling task, and no assistant tool would be need. The connection end 21 of the needle 20 is exposed that the operator may visually identify whether the cooper center conductor 1 is well connected to the needle 20.

Figure 4:
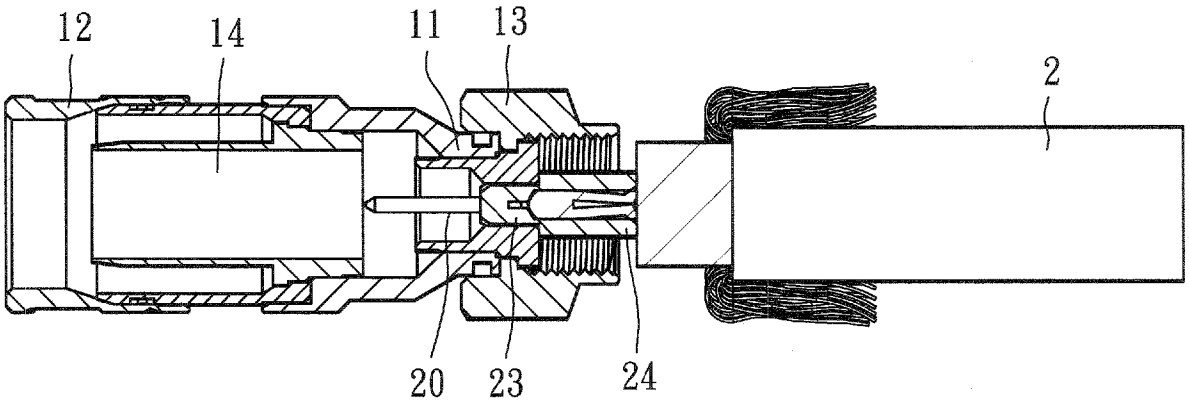
FIG. 4 is a sectional view of the preferred embodiment of the present invention, showing the cable and the needle in reverse connection.
Figure 5:
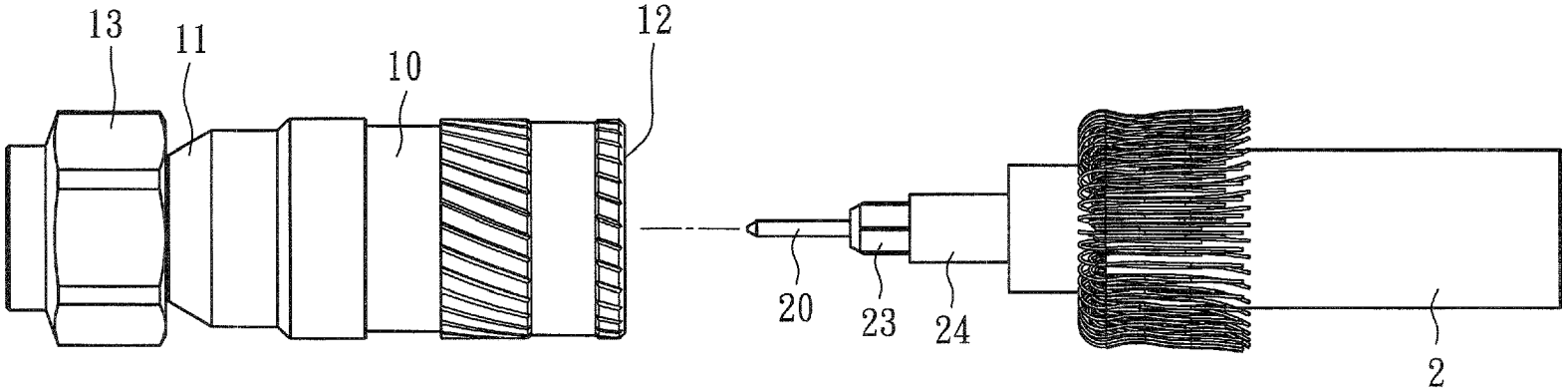
FIG. 5 is a lateral view of the preferred embodiment of the present invention, showing the cable and the needle for normal connection.
Figure 6:
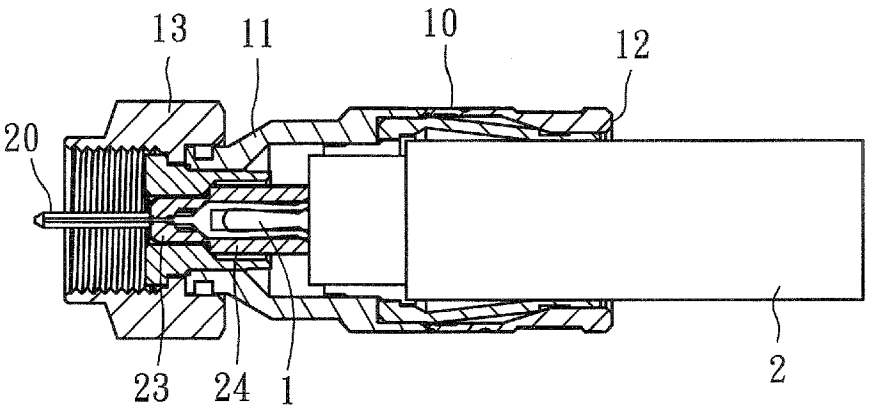
FIG. 6 is a sectional view of the preferred embodiment of the present invention, showing the cable and the needle in normal connection.

As shown in FIG. 4, the needle 20 only has the front section 23 of the barrel 22 inserted into the through hole 14 of the main member 10, and the needle 20 is connected to the cooper center conductor 1 of the cable 2 firmly that the operator may pull the cable 2 for disconnecting the needle 20 and the main member 1 easily.

In the step of reversing the main member 10 and connecting the needle 20 to the main member 10, there is no aligning problem of the needle 20 and the cooper center conductor 1 because they have been already connected together that the operator may insert the needle 20 together with the cable 2 into the main member 10 easily.

The present invention provides an assembling method of the cable connector and the cable that no assistant tool will be needed in the process, and there is no way of losing the needle as the conventional devices. The present invention also fixes the aligning problem of the needle and the cooper center conductor to increase the efficiency and quality of assembling the cable connector and the cable. The main character of the present invention is that we provide a reversible barrel for two connections, named reverse connection and normal connection. The operator should perform the reverse connection first for connection of the needle and the cooper center conductor, and then reverse the barrel and perform the normal connection for connection of the needle and the main member. It has a better efficiency and quality than the convention methods.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of assembling a cable and a cable connector, wherein the cable has a center conductor, and the cable connector has an outlet end and a connection end, comprising the step of:

inserting the center conductor of the cable to a connection end of a needle of the cable connector, wherein the needle is detachably connected to the outlet end of the cable connector in a reverse direction; and then pulling the cable together with the needle out of the cable connector because the needle is firmly connected with the center conductor of the cable; and then reversing the cable connector and inserting the needle together with the cable into the cable connector until the needle can not move anymore.

2. The method as claimed in claim 1, wherein the needle has the connection end left out of the outlet end of a main member in an initial condition.

3. The method as claimed in claim 2, wherein the cable connector has a through hole and the needle is reversely inserted into the through hole on the outlet end in the initial condition.

4. The method as claimed in claim 3, wherein the needle is provided with a barrel, which includes a front section having a smaller diameter and a rear section having a greater diameter, and the diameter of the rear section is greater than that of the through hole on the outlet end, so that when the cable conductor is reversed and the needle is inserted into the through hole, the front section of the barrel is inserted into the through hole too.

5. A cable connector, comprising:

a tubular main member having an outlet end and a connection end, wherein a nut is provided on the outlet end of the main member for rotation, and the main member has a through hole extended from the outlet end to the connection end, and the through hole is gradually narrowed from connection end to the outlet end that a diameter of the through hole on the outlet end is smaller than that on the connection end; and a needle, which is detachably and reversely connected to the outlet end of the main member, having a connection end and a tip that the tip thereof is pointed toward the connection end of the main member, and the connection end thereof is pointed toward the outlet end of the main member.

6. The cable connector as claimed in claim 5, wherein the connection end of the needle is left out of the outlet end of the main member.

7. The cable connector as claimed in claim 5, wherein the needle is provided with a barrel, which includes a front section having a smaller diameter and a rear section having a greater diameter, and the diameter of the rear section is greater than that of the through hole on the outlet end, and the diameter of the front section is smaller than that of the through hole on the outlet end, and the needle is reversely provided to the main member and has the front section of the barrel inserted into the through hole on the outlet end.

* * * * *